United States Patent [19]

Tessier

[11] Patent Number: 4,649,800

[45] Date of Patent: Mar. 17, 1987

[54] SELF-CONTAINED BLOWBACK-TYPE FIRING UNIT

[75] Inventor: Frederic G. Tessier, New Fairfield, Conn.

[73] Assignee: Shepherd Industries Limited, New Fairfield, Conn.

[21] Appl. No.: 736,991

[22] Filed: May 24, 1985

[51] Int. Cl.[4] ..... F41D 10/10; F41D 7/08

[52] U.S. Cl. ..... 89/194; 89/197

[58] Field of Search ..... 89/194, 195, 196, 197, 89/199, 4.5; 42/75 B, 75 C, 75 A, 75.01, 75.02

[56] References Cited

U.S. PATENT DOCUMENTS

| | | | |
|---|---|---|---|
| 1,063,882 | 6/1913 | Jones | 89/199 |
| 1,402,459 | 1/1922 | Swebilius | 42/75 C |
| 2,437,548 | 3/1948 | Patchett | 42/72 |
| 2,718,818 | 9/1955 | Cuppini et al. | 89/196 |
| 3,755,948 | 9/1973 | Heinicke | 89/196 |
| 3,776,096 | 12/1973 | Donovan | 42/75 B |
| 3,906,833 | 9/1975 | Orozco | 89/196 |
| 3,977,297 | 8/1976 | Orozco | 89/199 |
| 4,019,423 | 4/1977 | Johnson | 89/178 |
| 4,279,191 | 7/1981 | Johansson | 89/196 |
| 4,327,626 | 5/1982 | McQueen | 56/190 |
| 4,335,643 | 6/1982 | Gal | 89/196 |

FOREIGN PATENT DOCUMENTS

| | | | |
|---|---|---|---|
| 0123033 | 5/1947 | Australia | 89/194 |
| 1021314 | 2/1953 | France | 42/75 C |
| 1153181 | 3/1958 | France | 89/196 |
| 2043845 | 10/1980 | United Kingdom | 89/197 |

*Primary Examiner*—Stephen C. Bentley
*Assistant Examiner*—Stephen Johnson
*Attorney, Agent, or Firm*—Brown, Charles J.

[57] ABSTRACT

A self-contained blowback-type firing unit insertable in a gun body as a discrete subassembly and including a barrel and bolt with a compression spring acting between them, characterized in that the barrel and bolt slide together on matching longitudinal track surfaces which are other than cylindrical and circumferentially complete, the bolt being slideable on no surfaces other than the barrel track surfaces.

27 Claims, 7 Drawing Figures

SELF-CONTAINED BLOWBACK-TYPE FIRING UNIT

BACKGROUND OF THE INVENTION

Blowback-type automatic and semi-automatic firearms have a common principle of operation which simply stated is this: A bolt reciprocates with respect to a barrel affixed to a body of the weapon to carry successive cartridges from a magazine into a rearward open breech of the barrel in position to be fired by a firing pin on the bolt. The explosive force of the fired cartridge propels the bolt rearwardly against the force of one or more compression springs. In a semi-automatic firing mode the bolt is caught by detent means in its rearward position and is moved forwardly by the spring for the next firing cycle only by operation of a trigger. In an automatic firing mode the bolt is propelled forwardly by the spring for repeated reciprocation and firing so long as the trigger is depressed.

Representative blowback-type automatic and semi-automatic firearms include the Beretta, the Uzi (see U.S. Pat. No. 4,335,643) and the Mendoza (see U.S. Pat. No. 3,906,833). Other blowback-type firearms include those shown in U.S. Pat. Nos. 4,019,423 and 2,437,548. In all of these prior art designs the bolt reciprocates back-and-forth in sliding engagement with a cylindrical interior surface of the gun body. It is generally the practice in these conventional designs to add the bolt, barrel and spring one-by-one to the gun assembly as all of the parts are put together, not necessarily in immediate sequence and not as a separate independent subassembly. Field assembly and disassembly is therefore relatively complicated. Foreign matter making its way to the slideable interface between the bolt and gun body can seriously impair the operation of the weapon, and cleaning is both necessarily frequent and painstaking.

The compression spring in most of the prior art blowback-type firearms is aligned axially rearwardly of the barrel and bolt and relies upon a cap at the end of the gun body to provide a spring abutment in opposition to the bolt. The weapon disclosed in U.S. Pat. No. 3,906,833 is an exception to this but all of the other prior art designs mentioned above include the rearward spring contained by the gun body. This appreciably lengthens the weapon and increases its weight.

It is a principal object of the present invention to provide a self-contained blowback-type firing unit, the barrel-spring-bolt subassembly of which is insertable as a discrete unit in and of itself in a gun body. While none of the aforementioned prior art designs teaches such a discrete firing unit subassembly it is to be noted that U.S. Pat. No. 4,327,626 discloses to some extent a combination of barrel-spring-bolt which is assembled together and then assembled within the remainder of the gun, though without carrying that concept to its highest advantage. That patent described a barrel having a rearward spring abutment and securing means for affixing the barrel to the gun body. A compression spring parallel to the barrel has a rearward end abutting the rearward spring abutment. Parallel to the spring and barrel is a reciprocable bolt having a forward spring abutment against which the forward end of the spring abuts and a firing pin base axially rearwardly of the barrel with apertures defined between the forward spring abutment and the base permitting entry and ejection of successive cartridges relative to the barrel breech. The bolt and barrel are in longitudinal slideable engagement.

However, while U.S. Pat. No. 4,327,626 teaches a spring between forward and rearward abutments on the barrel and bolt, it does not recognize the advantage of a self-contained discrete firing unit subassembly. This is clear from the fact that the prior art patent continues to employ the inner cylindrical surface of the gun body as a guide in slideable engagement with the bolt, indeed at a plurality of places, thereby leaving unsolved the problem of entry of dirt and consequent malfunction. In addition this prior art patent describes encircling the bolt in cylindrical and circumferentially complete sliding engagement around the barrel, thus making it highly vulnerable to jamming from differential thermal expansion as the hotter barrel swells within the encircling bolt. Further evidence that this prior art patent fails to recognize the potential of a discrete firing unit is that in addition to the spring operating between the bolt and barrel it teaches the use of a second spring in the conventional position rearwardly of the bolt abutted at its other end by a cap at the very end of the gun body with all the attendant disadvantages of added length and weight characteristic of other prior art blowback-type firearms.

A further disadvantage of the weapon described in U.S. Pat. No. 4,327,626, and all of the other prior art designs mentioned above, is that a draw-back element for manually cocking the bolt is exposed on the exterior of the gun body and can injure the operator as it reciprocates rapidly during automatic firing.

Yet another disadvantage of the prior art weapons with a rearward spring is that such a design shifts the center of gravity of the weapon rearwardly thus increasing the tendency of the barrel to buck upwardly in an uncontrolled fashion during recoil.

A further significant disadvantage in all of the prior art blowback-type automatic and semi-automatic firearms is their multiplicity of parts. Assembly and disassembly in the field is difficult and time-consuming and the likelihood of mechanical failure from entry of foreign matter or incorrect assembly is substantial.

SUMMARY OF THE INVENTION

The invention provides an improvement in a self-contained blowback-type firing unit insertable as a discrete subassembly in a gun body. The firing unit includes a barrel with a forward muzzle and a rearward open breech and a rearward spring abutment and securing means for affixing the barrel to the gun body. The firing unit also includes a compression spring parallel to the barrel with a rearward end abutting the rearward spring abutment. It also includes a reciprocable bolt parallel to the spring and barrel having a forward spring abutment against which the forward end of the spring abuts and a firing pin base axially rearwardly of the barrel with apertures defined between the forward spring abutment and the base permitting entry and ejection of successive cartridges relative to the barrel breech. The bolt and barrel are in longitudinal slideable engagement.

The improvement comprises matching slideably engaged longitudinal track surfaces on the barrel and bolt respectively which are other than cylindrical and circumferentially complete and which prevent rotation of the bolt on the barrel, the bolt being free of slideable engagement with any surface other than the barrel track surfaces. In a preferred form of the firing unit the securing means on the barrel is the only support for the firing unit. It is also preferred that the securing means is forwardly on the barrel adjacent the muzzle and the firing unit is cantilevered rearwardly therefrom. The apertures in the firing unit are preferably longitudinal slot means formed in the bolt with opposed sides defining opposed track surfaces, and radially extending tongue means are formed on the barrel with opposed sides defining opposed barrel track surfaces, the slot means having a length sufficient to permit lateral entry of the barrel into the bolt during assembly. It is preferred that the tongue means be formed adjacent the breech of the barrel remote from the muzzle.

In these terms the firing unit of the invention is a marked improvement over that of U.S. Pat No. 4,327,626 because the present firing unit is truely a self-contained discrete subassembly wherein the bolt is not in slideable engagement with any surface other than non-encircling barrel track surfaces. The firing unit of the invention cannot jam because of foreign matter between the bolt and the inside of the gun body or because of differential thermal expansion of a relatively cool bolt track surface encircling a relatively hotter barrel. Since in its preferred form the securing means in the barrel is the only support for the firing unit, its parts and length are kept to a minimum and dimensional tolerances between the bolt-spring-barrel and the gun body are of little concern. In the gun body it may even be made of plastic. Since the muzzle end of the barrel is coolest during operation, location of the securing means there at that point minimizes the effect of differential thermal expansion. The design of the invention permits the simplest possible form of firing unit which can be readily inserted into and removed from the gun body with ease and little skill in the field.

Another distinct advantage of the invention is that the firing unit is interchangeable within various gun bodies since it is held in place only at its forward muzzle end in the preferred form. Conversely, different firing units of varying caliber can be inserted into a given style of gun body for a quick change in fire power.

These and further advantages of the improved self-contained blowback-type firing unit will be apparent from the following description.

DESCRIPTION OF PREFERRED EMBODIMENT

Figure 1:
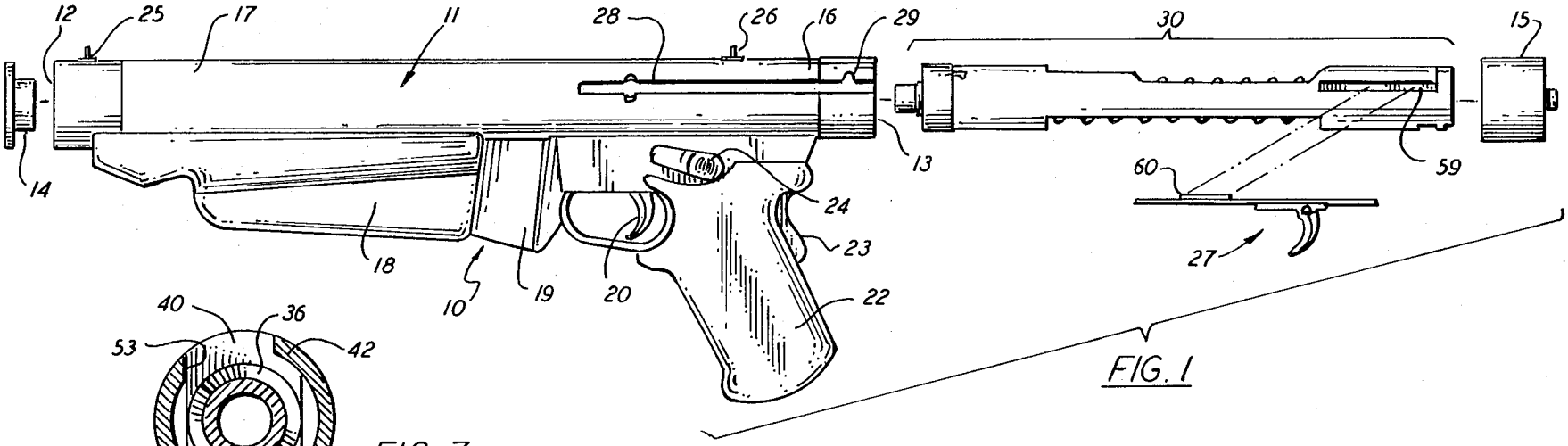
FIG. 1 is an exploded elevation of the firing unit of the invention along with but removed from the remaining parts of a gun body.

Referring first to FIG. 1, a gun body 10 is shown exploded in a disassembled state to include a cylindrical housing 11 having an open forward end 12 and an open rearward end 13. The open end 12 of the housing receives an annular forward cap 14 and the rearward end of the housing 13 receives a rearward cap 15. Both the forward and rearward caps 14 and 15 are detachable in a manner described hereinafter. A rearward portion 16 of the housing 11 has a length sufficient to enclose the reciprocable firing unit parts described below.

A forward end 17 of the housing 11 has attached to its underside a palm-held stock 18. Rearward of that is conventional cartridge magazine-receiving means 19. To the rear of the magazine-receiving means 19 is a conventional trigger 20 which cooperates through a suitable linkage (not shown) with a conventional sear 21 which is schematically suggested in each of FIGS. 3 to 6. To the rear of the trigger 20 is a pistol-type handle 22. The gun body 10 also includes conventional accompanying components such as a safety 23, a firing mode selector switch 24, a fore site 25 and a rear site 26. In addition a manual cocking element 27 is provided on the exterior of the rear portion 16 of the housing 11 of the gun body, operable in a slot 28 in the housing, to function in a manner described below. A bayonet indent 29 is also included in the rear portion 16 of the housing 11 for the rearward cap 15.

The gun body 11 with all of its attendent parts referred to above, in combination with a firing unit 30 described below and with a typical loaded magazine in place in the magazine-receiving means 19, has a center of gravity well forward of the trigger 20 and its accompanying sear 21. The advantage of the forward center of gravity is that it creates a downward turning moment around the shooter's hand grasping the pistol handle 22 and this moment offsets the upward turning moment generated by recoil during firing. The result is that the weapon is intentionally front-heavy and has less tendency to buck upwardly in the shooter's hand under the effect of recoil.

In addition the accuracy of the weapon of the invention is enhanced by the forward palm-held stock 18. Cradling of the front portion of the weapon with an upward palm (for example, the left hand of a right-handed shooter) in the manner of a shotgun is a more natural and easy manner of bringing the weapon quickly and accurately on target as compared to those automatic and semi-automatic weapons such as the Beretta which have a depending fist-held forward stock.

Figure 2:
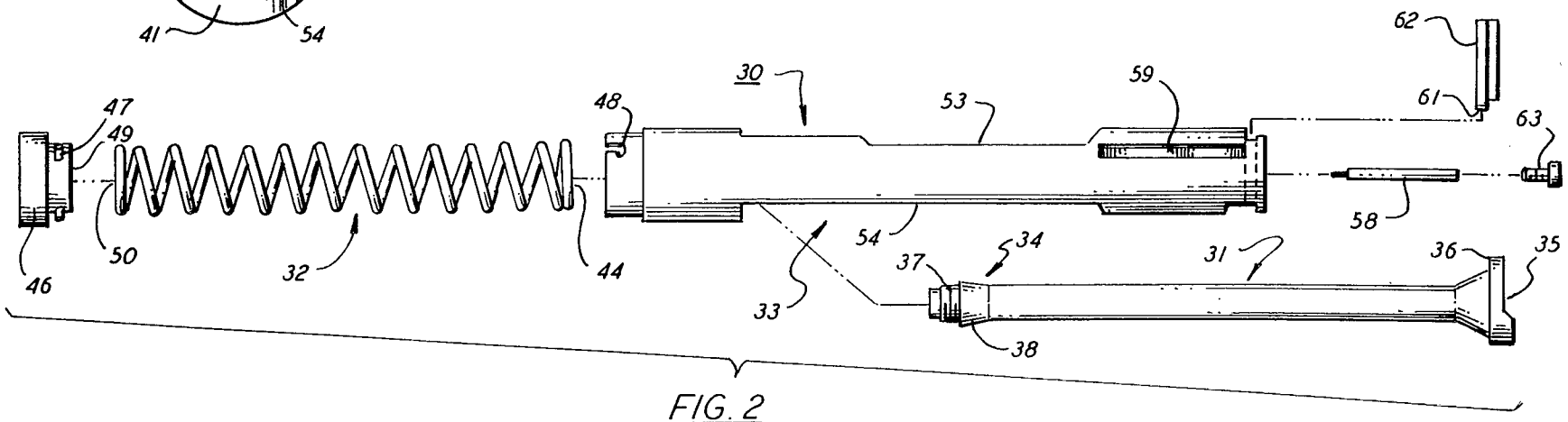
FIG. 2 is an exploded view of the parts of the firing unit itself showing the barrel-spring-bolt disassembled.

The firing unit 30 is indicated in FIG. 1 by a bracket and its principal parts are shown in an exploded view in FIG. 2. Three basic elements constitute the firing unit 30, namely a barrel 31, a compression spring 32 and a bolt 33. The barrel includes a forward muzzle portion 34 and a rearward open breech portion 35. A circular flanged rearward spring abutment 36 encirles the rearward breech portion 35 as shown particularly in FIG. 7.

The barrel also includes securing means for affixing it to the gun body, namely external threads 37 on the muzzle portion 34 and a shoulder 38 rearwardly thereof. A circular securing flange 39 (see FIGS. 3 to 6) is provided on the inside of the forward portion 17 of the housing 11 of the gun body 10, and the forward cap 14 of the gun body includes an internally threaded annulus. The firing unit is telescopically inserted into the housing 11 through the rearward open end 13 thereof so that the barrel muzzle 34 projects forwardly from the housing 11. The forward cap 14 is screwed by means of its internal threaded annulus onto the threads 37 on the barrel to hold the flange 39 of the housing 11 against the shoulder 38. This form of securing means constitutes the only support for the firing unit 30 within the gun body 11 and the unit is therefore cantilvered rearwardly from that point of support.

Figure 7:
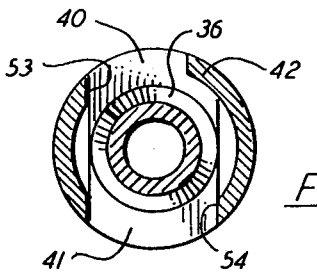
FIG. 7 is an enlarged transverse section taken along the line 7—7 of FIG. 3.

An upper radially extending tongue 40 extends from the breech portion 35 of the barrel and a downwardly extending tongue 41 extends from the breech portion in the opposite direction. In FIG. 7 it will be seen that the upwardly extending tongue 40 is narrower than the downwardly extending tongue 41 and includes a relatively small arcuate indented surface 42 coaxial with the barrel axis. As shown in FIGS. 3 to 6 the downwardly extending tongue 41 defines a ramp 43 which guides successive cartridges into the barrel breech as described hereinafter.

The compression spring 32 is disposed concentric with and around the barrel 31 as shown in FIGS. 3 to 6 with a rearward end 44 abutting the rearward spring abutment 36 on the barrel.

The reciprocable bolt 33 comprises a plurality of parts, the principal ones being shown in FIG. 2 and also in FIGS. 3 to 6. In its final assembly the bolt 33 is disposed concentric with and around the spring 32 and barrel 31. A separate annular element 46 is fitted onto the forward end of the bolt 33 and includes a bayonet pin 47 which enters a bayonet slot 48 for quick release and connection. The annular element 46 defines a circular flanged forward spring abutment 49 against which a forward end 50 of the spring 32 abuts.

At the opposite end of the bolt 33 is a firing pin base 51 which is disposed axially rearwardly of the barrel 33 as seen in FIGS. 3 to 6. Two apertures in the form of slots extend longitudinally along the length of the bolt 33 between the forward spring abutment 49 and the firing pin base 51. There is an upper slot 53 and a lower slot 54, the latter being somewhat wider than the former and of sufficient length to allow for lateral insertion of the barrel.

The bolt 31 and barrel 33 are in longitudinal slideable engagement. Matching slideably engaged longitudinal track surfaces are provided on the barrel 31 and the bolt 33 which are other than cylindrical and circumferentially complete and which prevent rotation of the bolt on the barrel. The upper slot 53 and lower slot 54 on opposite sides of the bolt each have opposed sides defining opposed track surfaces. The upper tongue 40 and lower tongue 41 on the barrel each define opposed barrel track surfaces. These surfaces are in sliding engagement as seen in FIG. 7. In addition, the arcuate surface 42 of the upper tongue 40 of the barrel engages a small segment of the cylindrical interior of the bolt 31 as shown in FIG. 7 though this is not in any sense an encircling sliding surface.

The firing pin base 51 of the bolt 33 further includes conventonal extractor means 57 appearing schematically in FIGS. 3 to 6 for pulling successive spent shells from the barrel breech. Firing pin means 58 in a central seat in the firing pin base are included to make firing contact with a cartridge when the bolt is reciprocated forwardly as described below. A draw-back element is provided in the firing pin base 51 in the form of an indented longitudinal slot 59 to cooperate with a corresponding land 60 on the manual cocking element 27 as described hereinafter. Detent means 61 are also included on the firing pin base to cooperate with the sear 21 in the conventional manner for cocking the bolt 33 against the force of the spring 32. As shown in FIG. 2 the detent 61 is part of a separate disc 62 which is removably secured by a bayonet connection to the rearward end portion of the bolt firing base 51. An axially disposed screw 63 passes through a center hole in the disc 62 to hold it in place, and at the same time locates the firing pin 58 within the central seat in the firing pin base 51.

A description of the assembly and operation of the device of the invention may commence with the gun body 10 considered to be assembled as shown in FIG. 1 except for connection of the forward and rearward caps 14 and 15 and the cocking element 27. As to the firing unit 30, it is separately assembled by first inserting the firing pin 58 in the firing pin base 51 and attaching the disc 62 all by means of the screw 63. Next the barrel 31 is laterally inserted into the bolt 33 through the lower slot 54 and advanced in a forward axial direction so that its muzzle 34 projects from the front of the bolt and the tongues 40 and 41 fit within the slots 53 and 54. At that point the annular element 46 is not yet attached. Next the spring 32 is telescoped through the open forward end of the bolt 33 concentrically around the barrel 31 and within the bolt until the rearward end 44 of the spring contacts the rearward spring abutment 36. The annular element 46 is then pushed in a rearward direction into the remainder of the bolt so that its forward spring abutment 49 compresses the spring 33 at the forward end 50 thereof and a final turning motion of the annular element 46 causes the bayonet pin 47 to lock in the slot 48, thus assembling the firing unit in the state shown in FIGS. 1 and 5.

It will be recognized that this assembly of the firing unit is of the utmost simplicity. It involves simply lateral insertion of the barrel into the bolt, a telescoping of the spring around the barrel so that its rearward end is abutted by the rearward spring abutment on the barrel, and a quick connection of the forward annular element by means of the bayonet attachment to complete the assembly. The firing unit at that point is a discrete subassembly ready for insertion into the gun body.

The assembly of the firing unit 31 with the gun body 10 is done in four simple and quick steps. First the cocking element 27 is connected to the bolt by placing the land 60 in the corresponding slot 59 in the firing pin base 51. Next the firing unit is telescoped forwardly from the position shown in FIG. 1 into the open rearward end 13 of the housing 11 until the shoulder 38 on the barrel abuts the inward flange 39 of the housing. The third step is simply to screw the forward cap 14 about the threads 37 on the muzzle of the barrel until the barrel is affixed with respect to the gun body by compression of the housing flange 39 between the shoulder 38 and the forward cap 14. Finally the rearward cap 15 is slipped over the end 16 of the housing 11 and with a quick turn is secured in its bayonet indent 29. As the firing unit 30 is advanced into the housing 11 the cocking element 27 is guided into the slot 28 in the housing. The weapon is now fully assembled.

Figures 3, 4, 5, 6:
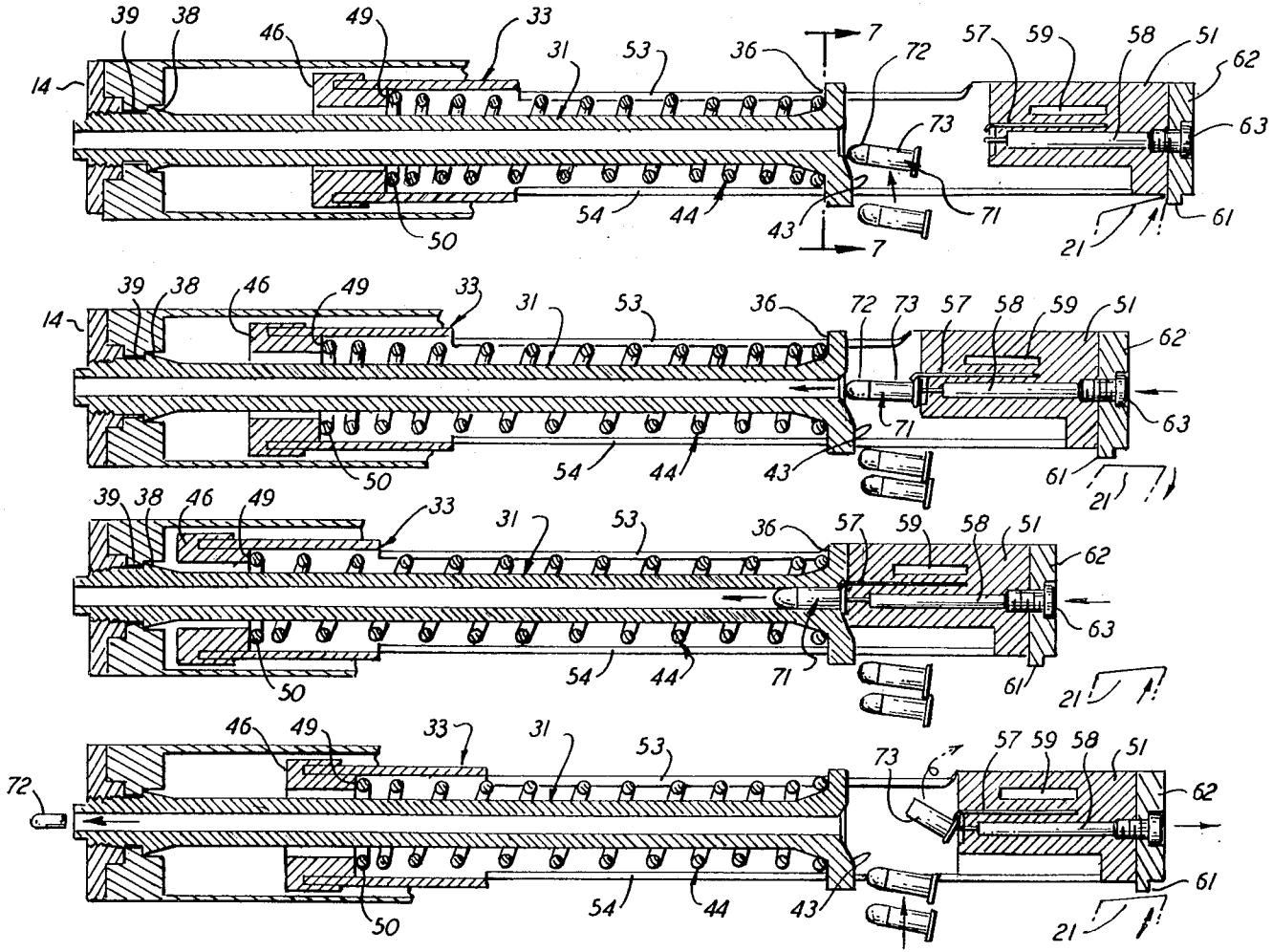
FIGS. 3 to 6 are longitudinal sections taken along the centerline of the firing unit showing the bolt in various stages of reciprocation with respect to successive cartridges.

The movement of the parts of the firing unit of the invention during firing is shown sequentially in FIGS. 3 to 6. The cocking element 27 is pulled rearwardly by hand in the slot 28 of the housing 11 until the sear 21 catches the detent 61 as shown in FIG. 3. At that point the cocking element is advanced forwardly to its initial position and is released from the bolt. The weapon is then in a cocked position.

Upon squeezing of the trigger 20 the detent 61 is released from the position of FIG. 3. Meanwhile a cartridge 71 comprising a bullet 72 and shell 73 is advanced upwardly in a conventional manner from its spring-biased magazine through the lower slot 54. Release of the sear 21 from the detent 61 permits the spring 32 to advance the bolt 33 forwardly to the left as shown in all of the figures. At the point in its reciprocation shown in FIG. 4 the cartridge 71 is contacted by the firing pin base and advanced forwardly, guided by the ramp 43, into the breech portion of the barrel 31. When fully inserted in the breech as shown in FIG. 5 the firing pin 58 detonates the cartridge 71. At this point the bolt 33 is in its forwardmost position.

The explosive affect of the fired cartridge causes the bolt 33 to be propelled rearwardly as shown in FIG. 6 and as the bullet 72 exits from the muzzle of the weapon the extractor 57 pulls the spent shell 73 from the barrel breech and a conventional ejector (not shown) within the gun body displaces it outwardly through the upper slot 53 of the bolt.

If the weapon is on automatic firing mode, the sear 21 does not engage the detent 61 so long as the trigger 20 is squeezed and therefore the bolt 33 reciprocates back to its FIG. 3 position and immediately advances forward for another cycle. In the semi-automatic firing mode the sear 21 engages the detent 61 and only another squeezing of the trigger will cause the firing cycle to be repeated.

Throughout all of these stages of reciprocation of the parts of the firing unit, the barrel 31 and bolt 33 are in slideable engagement with one another along the matching longitudinal track surfaces shown in FIG. 7. These surfaces are not cylindrical and circumferentially complete and the bolt therefore does not encircle the barrel, though it does prevent rotation of the bolt on the barrel. It will be recognized that the bolt is free of slideable engagement with any surface other than the barrel track surfaces. It slides only on the sides of the tongues 40 and 41 and the small arcuate surface 42. There is ample clearance within the housing 11 to permit the bolt 33 to reciprocate back and forth telescopically within the housing 11 without in any way contacting the interior surfaces of the housing. The entire support of the firing unit throughout this firing sequence is at its forward end where the muzzle is secured to the housing.

The scope of the invention is set forth in the following claims and is not limited to the specific preferred embodiment described above.

I claim:

1. In a self-contained blowback-type firing unit insertable as a discrete subassembly in a gun body, which includes a barrel with a forward muzzle and a rearward open breech and a rearward spring abutment and securing means for affixing the barrel to the gun body, and which includes a compression spring parallel to the barrel with a rearward end portion abutting the rearward spring abutment, and which further includes a reciprocable bolt parallel to the spring and barrel, the bolt comprising a forward spring abutment against which a forward end portion of the spring abuts and a firing pin base axially rearwardly of the barrel with apertures defined between the forward spring abutment and the firing pin base permitting entry and ejection of successive cartridges relative to the barrel breech, the bolt and barrel being in longitudinal slideable engagement, the improvement which comprises (a) matching slideably engaged longitudinal track surfaces on the barrel and bolt respectively defined by radially extending tongue means on one of the barrel and bolt and slot means on the other of the barrel and bolt and which prevent rotation of the bolt on the barrel, the barrel track surfaces being limited to a location rearwardly of the rearward end portion of the spring;

(b) the bolt being free of longitudinal slideable engagement with any surface other than the barrel track surfaces.

2. A firing unit according to claim 1 wherein the securing means on the barrel is the only support for the firing unit.

3. A firing unit according to claim 2 wherein the securing means is forwardly on the barrel adjacent the muzzle and the firing unit is cantilevered rearwardly therefrom.

4. A firing unit according to claim 1 wherein said slot means are on the bolt and comprise said apertures permitting entry and ejection of successive cartridges and have a length sufficient to permit lateral entry of the barrel during assembly.

5. A firing unit according to claim 4 wherein the tongue means are formed adjacent the breech of the barrel remote from the muzzle.

6. A firing unit according to claim 4 wherein the slot means are two slots on opposite sides of the bolt and the tongue means are two tongues on opposite sides of the barrel.

7. A firing unit according to claim 1 wherein the bolt further comprises (a) extractor means for pulling successive spent cartridge shells from the breech;

(b) firing pin means in the bolt base adapted to make firing contact with a cartridge when the bolt is reciprocated by the spring to its forwardmost position;

(c) a draw-back element for cocking the bolt against the spring; and (d) detect means for holding the bolt in a rearward cocked position and releasing it therefrom.

8. In a self-contained blowback-type firing unit insertable as a discrete subassembly in a gun body, which includes a barrel with a forward muzzle and a rearward open breech and a rearward circular flanged spring abutment and securing means for affixing the barrel to the gun body, and which includes a single compression spring concentric with the barrel with a rearward end portion abutting the rearward spring abutment, and which further includes a reciprocable bolt concentric with the spring and barrel, the bolt comprising a circular flanged forward spring abutment against which a forward end portion of the spring abuts and a firing pin base axially rearwardly of the barrel with apertures defined between the forward spring abutment and the firing pin base permitting entry and ejection of successive cartridges relative to the barrel breech, the bolt and barrel being in longitudinal slideable engagement, the improvement which comprises (a) matching slideably engaged longitudinal track surfaces on the barrel and bolt respectively defined by radially extending tongue means on one of the barrel and bolt and slot means on the other of the barrel and bolt and which prevent rotation of the bolt on the barrel, the barrel track surfaces being limited to a location rearwardly of the rearward end portion of the spring;

(b) the bolt being free of longitudinal slideable engagement with any surface other than the barrel track surfaces;

(c) the securing means on the barrel being the only support for the firing unit;

(d) the securing means being forwardly on the barrel adjacent the muzzle and the firing unit being cantilevered rearwardly therefrom.

9. A firing unit according to claim 8 wherein the bolt further comprises (a) extractor means for pulling successive spent cartridge shells from the breech, (b) firing pin means in the bolt base adapted to make firing contact with a cartridge when the bolt is reciprocated by the spring to its forwardmost position, (c) a draw-back element for cocking the bolt against the spring, and (d) detent means for holding the bolt in a rearward cocked position and releasing it therefrom.

10. A firing unit according to claim 9 wherein the detent means is detachable from the remainder of the bolt.

11. A firing unit according to claim 9 in combination with said gun body, said gun body further comprising manual cocking means on the exterior thereof for operating the bolt draw-back element and being separable from the bolt draw-back element after cocking.

12. A firing unit according to claim 8 in combination with said gun body, said body further comprising a housing having open forward and rearward end portions, the firing unit being telescopically inserted in the housing through the housing rearward end portion with the barrel muzzle projecting forwardly therefrom and affixed by the securing means to the housing forward portion, the housing rearward portion having a length sufficient to enclose the rearward end of the bolt throughout its reciprocation, and a detachable rear cap covering the open end of the housing rear portion, substantially the entire firing unit but for the projecting barrel muzzle being enclosed within said housing and rear cap.

13. A combination according to claim 12 wherein the securing means on the barrel muzzle comprises external threads and a shoulder rearwardly thereof, a circular securing flange is provided at the forward end of the housing, and an internally threaded annulus is screwed onto said threads to hold the flange of the housing against said shoulder.

14. A firing unit according to claim 8 in combination with said gun body, said body firing comprising magazine-receiving means rearward of said barrel.

15. A combination according to claim 14 wherein the body further comprises a palm-held stock forward of the magazine-receiving means.

16. A combination according to claim 14 wherein the body further comprises trigger-and-sear means for selectively holding and releasing the bolt detent means.

17. A combination according to claim 16 wherein the body further comprises a pistol-type handle rearward of the trigger-and-sear means, the combination having a center of gravity forward of the trigger-and-sear means.

18. In a self-contained blowback-type firing unit insertable as a discrete subassembly in a gun body, which includes a barrel with a forward muzzle and a rearward open breech and a circular flanged rearward spring abutment and securing means for affixing the barrel to the gun body, and which includes a single compression spring concentric with and around the barrel with a rearward end portion abutting the rearward spring abutment, and which further includes a reciprocable bolt concentric with and around the spring and barrel, the bolt comprising a circular flanged forward spring abutment against which a forward end portion of the spring abuts and a firing pin base axially rearwardly of the barrel with apertures defined between the forward spring abutment and the firing pin base permitting entry and ejection of successive cartridges relative to the barrel breech, the bolt and barrel being in longitudinal slideable engagement, the improvement which comprises (a) matching slideably engaged longitudinal track surfaces on the barrel and bolt respectively defined by two radially extending tongues on opposite sides of the barrel adjacent the breech of the barrel remote from the muzzle and limited to a location rearwardly of the rearward end portion of the spring and two slots on opposite sides of the bolt having a length sufficient to permit lateral entry of the barrel during assembly and comprising the apertures permitting entry and ejection of successive cartridges, the respective tongues engaging opposite sides of the respective slots and preventing rotation of the bolt on the barrel, the barrel track surfaces being limited to a location rearwardly of the rearward end portion of the spring;

(b) the bolt being free of longitudinal slideable engagement with any surface other than the barrel track surfaces;

(c) the securing means on the barrel being the only support for the firing unit;

(d) the securing means being forwardly on the barrel adjacent the muzzle and the firing unit being cantilevered rearwardly therefrom.

19. A firing unit according to claim 18 wherein the bolt further comprises (a) extractor means for pulling successive spent cartridge shells from the breech, (b) firing pin means in the bolt base adapted to make firing contact with a cartridge when the bolt is reciprocated by the spring to its forwardmost position, (c) a draw-back element for cocking the bolt against the spring, and (d) detent means for holding the bolt in a rearward cocked position and releasing it therefrom.

20. A firing unit according to claim 19 wherein the detent means is detachable from the remainder of the bolt.

21. A firing unit according to claim 19 in combination with said gun body, said body further comprising manual cocking means on the exterior thereof for operating the bolt draw-back element and being separable from the bolt draw-back element after cocking.

22. A firing unit according to claim 18 in combination with said gun body, said body further comprising a housing having open forward and rearward end portions, the firing unit being telescopically inserted in the housing through the housing rearward end portion with the barrel muzzle projecting forwardly therefrom and affixed by the securing means to the housing forward portion, the housing rearward portion having a length sufficient to enclose the rearward end of the bolt throughout its reciprocation, and a detachable rear cap covering the open end of the housing rear portion, substantially the entire firing unit but for the projecting barrel muzzle being enclosed within said housing and rear cap.

23. A combination according to claim 22 wherein the securing means on the barrel muzzle comprises external threads and a shoulder rearwardly thereof, a circular securing flange is provided at the forward end of the housing, and an internally threaded annulus is screwed onto said threads to hold the flange of the housing against said shoulder.

24. A firing unit according to claim 18 in combination with said gun body, said body further comprises magazine-receiving means rearward of said barrel.

25. A combination according to claim 4 wherein the body further comprises a palm-held stock forward of the magazine-receiving means.

26. A combination according to claim 24 wherein the body further comprises trigger-and-sear means for selectively holding and releasing the bolt detent means.

27. A combination according to claim 26 wherein the body further comprises a pistol-type handle rearward of the trigger-and-sear means, the combination having a center of gravity forward of the trigger-and-sear means.

* * * * *